US005524886A

United States Patent [19]

Kim

[11] Patent Number: 5,524,886

[45] Date of Patent: Jun. 11, 1996

[54] ADJUSTABLE SWIVEL NUNCHAKU

[76] Inventor: Myung K. Kim, 11642 Palmwood Dr., Garden Grove, Calif. 92640

[21] Appl. No.: 296,327

[22] Filed: Aug. 25, 1994

[51] Int. Cl.[6] ..... F41B 15/02

[52] U.S. Cl. ..... 273/84 R

[58] Field of Search ..... 273/84 R, 84 FS, 273/84 A; 403/185 C, 164; 24/298, 299

[56] References Cited

U.S. PATENT DOCUMENTS

| | | | |
|---|---|---|---|
| 3,608,899 | 9/1971 | Hall | 273/84 A |
| 4,017,073 | 4/1977 | Dolan | 273/84 A |
| 4,070,023 | 1/1978 | Cutler | 273/83 A |

OTHER PUBLICATIONS

*Blackbelt*, "New Concept, "Dec. 1975, p. 30.
Nunchakus sold by Century (800) 626–2787.

*Primary Examiner*—William M. Pierce

[57] ABSTRACT

An adjustable nunchaku (10) comprises a pair of handles (12,14) attached together with a flexible member (20). The flexible member (20) is selectively attached to the handles (12,14) so that the length of flexible member (20) separating the handles (12,14) can be easily adjusted. The excess length of flexibly member (20) not used to hold the handles (12,14) together is stored in a passageway (26) in the handles (12,14). Further, the handles (12,14) are selectively attached to the flexible member (20) so that the handles (12,14) can be interchanged to change or fix the handles (12,14).

15 Claims, 2 Drawing Sheets

22,24

ADJUSTABLE SWIVEL NUNCHAKU

BACKGROUND

This invention is directed to a martial arts training device and weapon, namely an adjustable nunchaku.

Nunchaku are a well know martial arts training device and weapon. They have been so, in the United States, at least since Bruce Lee used them in the movie "Enter The Dragon". Typical nunchaku consist of two hardwood handles joined together at their ends with a short length of chain or cord. During combat, one handle is held in one hand while the other, free handle is swung at the opponent.

During practice and prior to combat, for physiological reasons and to confuse the opponent, one handle is held in one hand while the other, free handle is swung over the shoulder, under the arm, under the leg and around the waist of the person using the nunchaku. If the nunchaku is too long or short, the free handle will not flow freely and fluidly around the body of the user. Since no two users have the same arm length or body shape, the user must adjust to the nunchaku to ensure smooth and fluid movement of the free handle of the nunchaku.

Furthermore, the handles of the nunchaku can be made in many different shapes, colors or from different materials. Since no two people are alike, the preferred shape, color and type of material utilized in the handles of the nunchaku varies.

Presently, nunchaku are available with different predetermined lengths of chain or cord separating the handles, handles which are made from different materials, such as plastic, rubber or rosewood and handles which have different shapes. However, none of these nunchaku can be adjusted to suit the arm length, body shape, and/or personal preference of the particular user. Moreover, none of these nunchaku have interchangeable handles to allow the replacement of broken handles, the use of different shaped and/or colored handles or handles made of a different material. Thus, a martial arts studio would have to buy many different nunchaku to suit a variety students, at a great cost to the studio.

Further, a significant mental advantage can be gained physiologically over an opponent before combat simply by generating a menacing sound with the nunchaku. Presently, the only sounds emanating from the nunchaku are the sound of the free handle moving through the air and/or the free handle contacting the body or an object.

Accordingly, there is a need for an adjustable nunchaku which allows the user to adjust the nunchaku and interchange the handles of the nunchaku, thereby facilitating the use of the nunchaku for a variety of students. Further, for physiological reasons and/or stunts and demonstrations, it is desirable to enhance the sound which can be generated by the nunchaku.

SUMMARY

The present invention is directed to nunchaku that meets these needs. Nunchaku according to the present invention comprise (i) a first handle suitable for gripping with a human hand, the first handle having an attachment end, (ii) a second handle also suitable for gripping with a human hand, the second handle also having an attachment end, (iii) a flexible member, typically a chain, (iv) a first attacher for attaching the attachment end of the first handle to the flexible member, and (v) a second attacher for attaching the attachment end of the second handle to the flexible member. As described below, the present invention provides an easy and reliable way to (i) change the length of flexible member separating the two handles and (ii) change handles.

In a first version of the invention, the length of the flexible member separating the attachment ends of the first and second handles can be selectively adjusted to suit the arm length, body shape and/or personal preference of the particular user so that the free handle travels freely and smoothly around the body of the user. Typically, the first attacher and more preferably, also the second attacher are selectively attached to the flexible member so that the length of flexible member separating the attachment ends of the first and second handles can be selectively adjusted to suit the needs of the particular user.

In one embodiment of the first version of the invention, (i) at least the first handle includes a first passageway which extends from the attachment end into the first handle, (ii) the flexible member has at least two member apertures extending therethrough and (iii) the first attacher includes a swivel connector and a selectively removable fastener. Preferably, the first passageway extends along a central axis of the first handle to balance the handle.

The swivel connector has a central axis, first and second opposed ends, and a swivel aperture extending along the central axis of the swivel connector. The swivel connector is capable of relative rotational movement around its central axis and between its first and second ends.

The second end of the swivel connector is fixable attached to the attachment end of the first handle. The selectively removable fastener extends through one of the member apertures in the flexible member and a corresponding attachment aperture in the first end of the swivel connector. The swivel connector allows the handle to rotate relative to the flexible member so that the flexible member does not bind or become wound. The second handle preferably has the same structure described above to balance the nunchaku, prevent binding of the flexible member and provide flexibility in the adjustment of the length of the flexible member which separates the handles.

In the first version of the invention, a portion of the flexible member can extend through the swivel aperture in the swivel connector into the first passageway. If the flexible member is a chain, it can rattle inside the first passageway and generate noise.

In a second version of the invention, the first attacher and more preferably, the second attacher are selectively attached to the attachment end of the first handle and the second handle respectfully. For example, the first and second attachers can include an attacher connector and each attachment end of the first and second handles can include a mating handle connector. The attacher connector can include an internally threaded surface and the handle connector can include a mating externally threaded surface. Thus, the first and second handles can be easily detached and reattached to the first and second attachers respectfully, to change the handles of the nunchaku, i.e. put on handles made of a different material, change the color and/or shape of the handle(s) and/or replace a broken or damaged handle.

The present invention overcomes disadvantages of the prior art nunchaku since the length of flexible member separating the handles can be easily adjusted and the handles can be interchanged.

DRAWINGS

These and other features, aspects, and advantages of the present invention will become better understood from the following description, appended claims, and accompanying drawings where:

DESCRIPTION

Figure 1:
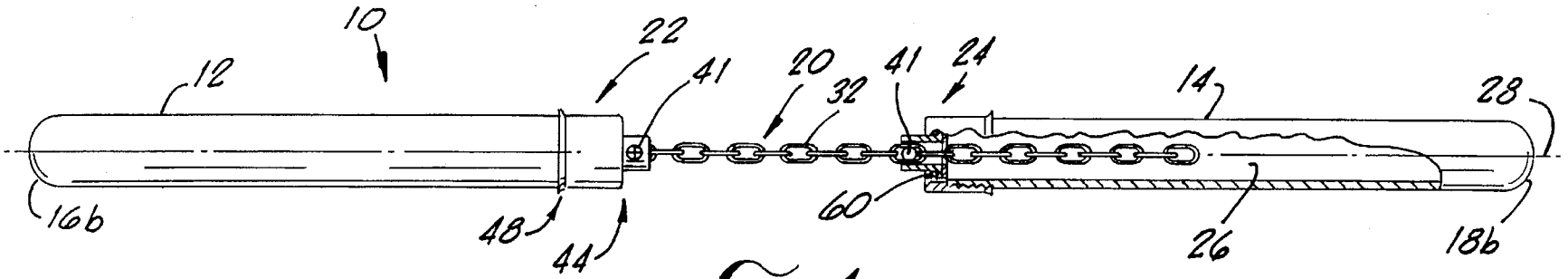
FIG. 1 is a side, partially cut-away view of a nunchaku having features of the present invention.

A martial arts weapon and training device, i.e. a nunchaku 10, according to the present invention is designed to be adjustable to suit the arm length, body size and personal preference of the particular person who uses the nunchaku 10 and have handles 12,14 which are interchangeable. Nunchaku 10 according to the present invention comprise (i) a first handle 12 having an attachment end 16*a*, (ii) a second handle 14 having an attachment end 18*a*, (iii) a flexible member 20, (iv) a first attacher 22 and (v) a second attacher 24. The first attacher 22 is used to attach the attachment end 16*a* of the first handle to the flexible member 20 and the second attacher 24 is used to attach the attachment end 18*a* of the second handle to the flexible member 20.

Although the present invention is described as a martial arts weapon and training device, such as a nunchaku 10, the invention can also be other martial arts weapons such as a three sectional staff.

The first and second handles 12,14 are sized and shaped to be suitable for gripping with the human hand. Each handle 12,14 has a free end 16*b*,18*b* opposed from the attachment end 16*a*,18*a*. Typically, the handles 12,14 are made of a hard wood such as oak or redwood. However, the handles 12,14 can be made of a hard plastic, an aluminum tube or even a hard rubber. The handles 12,14 can be any color including the natural color of the wood, black, silver, or red.

Figure 2:
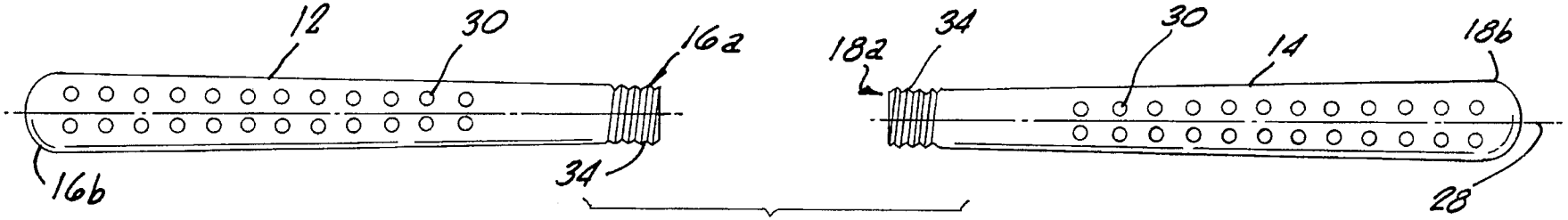
FIG. 2 is a side view of cylindrical, tapered handles which can be used in the nunchaku of claim 1.
Figure 3:
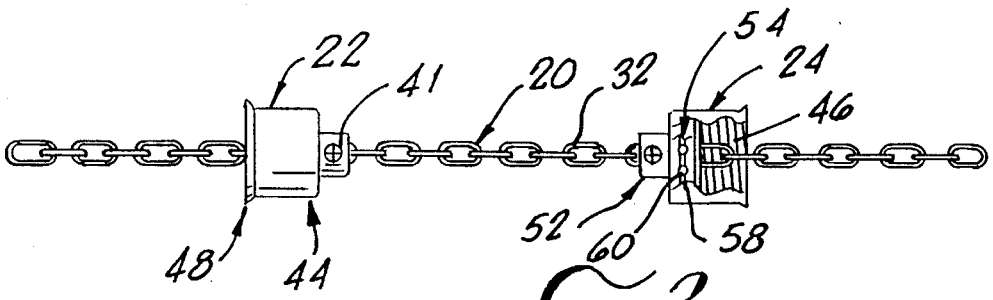
FIG. 3 is a side, partially cut-away view of the first and second attachers and the flexible member of the nunchaku of claim 1.
Figure 5:
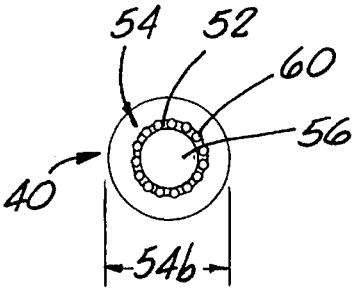
FIG. 5 is a top plan view of the swivel connector of FIG. 4 taken on line 5—5 in FIG. 4.
Figure 6:
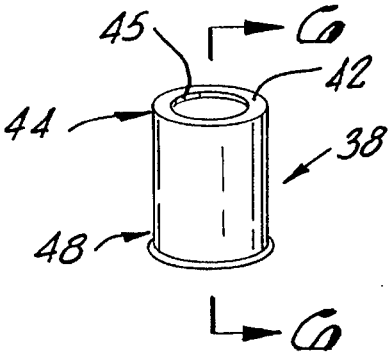
FIG. 6 is a cut away view of the housing of FIG. 4 taken on line 6—6 in FIG. 4.
Figure 6:
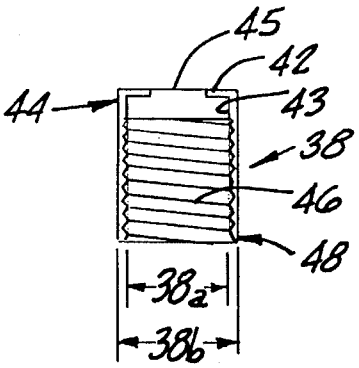

As shown in FIG. 1, the handles 12,14 can have the shape of a right circular cylinder, having a diameter of about one (1) inch and a length of about twelve (12) inches. Alternatively, the handles 12,14 can have a circular cross-section which tapers from the free end 16*b*,18*b* to the attachment end 16*a*,18*a* as shown in FIG. 2, or the handles 12,14 can have the cross-sectional shape of an octagon (not shown).

Each handle 12,14 can have a passageway 26 which extends from the attachment end 16*a*,18*a* into the handle 12,14 along a central axis 28 of the handle 12,14. The length and size of the passageway 26 depends upon the size of the flexible member 20 extending into the passageway 26, the size and desired strength of the handles 12,14 and the material utilized in the handles 12,14. For example, if the flexible member 20 is large, the passageway 26 must be large to allow space for the excess flexible member 20. As the size of the passageway 26 increases, the handles 12,14 become lighter and the strength of the handles 12,14 is reduced. In the embodiment shown in FIG. 1, the passageway 26 has a circular cross-section of about five-eighths (⅝) of an inch and extends almost the entire length of the handles 12,14.

If a portion of flexible member 20 is inside the passageway 26, the flexible member 20 can strike against the passageway 26 during use of the nunchaku 10 creating a rattling sound. Further, if the handles 12,14 are made a thin walled metal or aluminum tube, and the flexible member 20 is a chain, the chain contacting against the inside of the tube can generate great sound.

To further enhance the sound of the nunchaku 10, the handles 12,14 can have sound apertures 30 which extend transversely into the passageway 26. The sound apertures 30 are sized, spaced and positioned so that sound can be generated by the sound apertures 30 when the handles 12,14 are moved through the atmosphere. The size, shape and position of the sound apertures 30 depend upon how fast the handles 12,14 are moved by the user, and the size of the passageway 26. Preferably, the sound apertures 30 are positioned equally around the circumference of the handles 12,14 so that the sound apertures 30 generate sound every way that the handles 12,14 are moved.

Preferably, each attachment end 16*a*,18*a* includes a handle connector 34 for selectively attaching each handle 12,14 to its respective attacher 22,24. As shown in FIGS. 1 and 2, the handle connector 34 can be an externally threaded surface. Alternatively, the handle connector 34 can comprise of opposed pins (not shown) extending transversely from the attachment end 16*a*, 18*a* or an external circumferential groove (not shown) in the attachment end 16*a*,18*a* or some other type of male connector.

The flexible member 20 can be a length of chain or any durable flexible member 20 such a leather or nylon strap (not shown). The flexible member 20 has at least two member apertures 32 extending transversely therethrough for attaching the flexible member 20 to the attachers 22,24. Preferably, the flexible member 20 has a plurality of member apertures 32 to provide a large range in adjustment to the length of flexible member 20 separating the handles 12,14. If the flexible member 20 is a chain, opening of the chain links are used as the member apertures 32. In the embodiment shown if the Figures, a chain having a link length of about one-half (½) of an inch and a link width of about three-eighths (⅜) of an inch provides a strong, lightweight and durable flexible member 20.

The length of the flexible member 20 depends upon the desired range of adjustment of the nunchaku 10. The desired length of the flexible member 20 separating the handles 12,14 depends upon the specific user of the nunchaku 10. For example, the desired length of the flexible member 20 separating the handles 12,14 can range between a length equal to the cross-sectional diameter of one handle to a length equal to the armspand of a user minus the handle 12,14 length. Typically, however, the desired length of flexible member separating the handles 12,14 is between about three and one-half (3½) inches and to about six and one-half (6½) inches.

As described previously, the first and second attachers 22,24 attach the attachment end 16*a*,18*a* of the first and second handles 12,14 respectfully, to the flexible member 20. Each attacher 22,24 can comprise of a tubular shaped housing 38, a swivel connector 40 fixedly attached to the housing 38 and a selectively removable fastener 41.

In the embodiment shown in the Figures, the housing 38 has an inner cross-sectional diameter 38*a* of about seven-eighths (⅞) of an inch and an outer cross-sectional diameter 38*b* of about one (1) inch. The housing 38 has a reduced section 43 having a reduced inner cross-sectional diameter and an end cap 42 at one end 44 of the housing 38 for fixedly holding the swivel connector 40 in place. The end cap 42 has an opening 45 for the swivel connector 40 to extend therethrough. An attacher connector 46 is disposed at an opposed end 48 of the housing 38. In the embodiment shown in the Figures, the attacher connector 46 is a internally threaded surface which mates with the externally threaded surface of the handle connector 34. Alternatively, the attacher connector 46 can comprise of opposed internal channels (not shown) sized and shaped to receive the opposed pins (not shown) in the handle connector 34 in a bayonet style coupling or a sliding ring (not shown) and a plurality of spherical balls (not shown) which mate with the circumferential groove (not shown) in the handle connector 34 in a snap-ring style coupling.

Further an adhesive (not shown) can be placed between the handle connector 34 and the attachment connector 46 to fixedly secure each handle 12,14 to its respective attacher 22,24.

The swivel connector 40 aids in preventing the flexible member 20 from binding or becoming twisted during use of the nunchaku 10, thereby reducing the strength of the flexible member 20 and/or disrupting the use of the nunchaku 10. The swivel connector 40 has a central axis 50 and first and second opposed ends 52,54. A swivel aperture 56 extends through the central axis 50. The flexible member 20 extends through the swivel aperture 56. The swivel connector 40 is capable of relative rotational movement between its first and second ends 52,54, around its central axis 50.

With reference to Figures, the first end 52 of the swivel connector 40 has a tubular shape. In the embodiment shown in the drawings, the first end 52 has an inner diameter **52*a* about seven-sixteenths (7/16) of an inch and an outer diameter 52*b* of about nine-sixteenths (9/16) of an inch. These dimensions vary according to the size of the flexible member 20 and the housing 38. The inner diameter 52*a* of the first end 52 forms the swivel aperture 56. The outer diameter of the first end 52 includes an external circumferential channel 58 for receiving ball bearings 60**.

Further, the first end 52 includes an attachment aperture 64 extending transversely therethrough. The size and shape of the attachment aperture 64 depends upon the size and shape of the removable fastener 41. The removable fastener 41 extends through the member aperture 32 of the flexible member 20 and the attachment aperture 64 to attach the handles 12,14 to the flexible member 20.

The second end 54 of the swivel connector 40 also has a tubular shape and is sized to fit over the first end 52 and be fixedly attached to the housing 38. Thus, the second end 54 has an inner diameter **54*a* which is larger than the outer diameter 52*b* of the first end 52. In the embodiment shown in the figures, the second end 54 has an inner diameter of about five-eighths (5/8) of an inch and an outer diameter of about three-fourths (3/4) of an inch. The outer diameter 54*b* of the second end 54 is sized to be interference fitted with the reduced section 43 of the housing 38 so that the second end 54 is fixedly secured to the housing 38. The inner diameter 54*a* includes an internal circumferential channel 62 mating with the external circumferential channel 58 for receiving the ball bearings 60. The ball bearings 60 provide smooth and easy rotation between the first and second ends 52,54 of the swivel connector 40**.

Alternatively, a bushing (not shown) or other device which operates in the same fashion can be used instead of the ball bearing 60 between the first and second ends 52,54.

Figure 4:
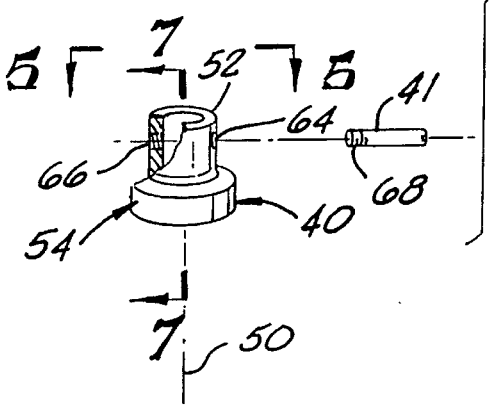
FIG. 4 is an assembly view, with partial cut-away, of the attachers having features of the present invention.
Figure 7:
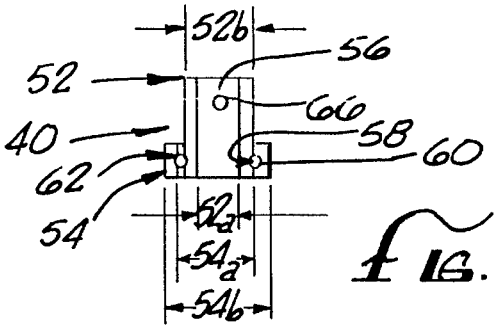
FIG. 7 is a cut away view of the swivel connector of FIG. 4 taken on line 7—7 in FIG. 4.

The removable fastener 41 can be a male-female connector such as a nut and bolt or a pin which extends through the member aperture 32 and the attachment aperture 64. Preferably, to save space and weight, as shown in FIG. 4, the attachment aperture 64 includes an internally threaded surface 66 and the removable fastener 41 is a bolt having a mating externally threaded surface 68. An adhesive (not shown) can be placed in the male-female connector to secure the removable fastener 41.

Nunchaku 10, according to the present invention, allows the user (i) to adjust the length of flexible member 20 separating the handles 12,14 and (ii) interchange the handles 12,14. The length of flexible member 20 separating the handles 12,14 can be adjusted by removing the removable fastener 41, adjusting the length of flexible member 20 separating the handles 12,14 and reinstalling the removable fastener 41. The handles 12,14 can be interchanged by simply detaching and reattaching the handle connector 34 from the attacher connector 46.

Although the present invention has been described in considerable detail with reference to certain preferred versions, many other versions should be apparent to those skilled in the art. For example, the swivel aperture 56 could have a cross section which is oval or some other shape which corresponds to the shape of the flexible member 20. Therefore, the spirit and scope of the appended claims should not necessarily be limited to the description of the preferred versions contained herein.

What is claimed is:

1. A martial arts training device and weapon comprising:

(a) a first and second handles, suitable for gripping with a human hand, each handle having an attachment end, wherein, at least the first handle includes a first passageway which extends from the attachment end into the first handle;

(b) a flexible member having at least two spaced apart member apertures extending therethrough;

(c) a first attacher for attaching the first handle to the flexible member; and (d) a second attacher attached proximate to the attachment end of the second handle for attaching the second handle to the flexible member;

wherein the first attacher includes (i) a first swivel connector attached proximate to the attachment end of the first handle, the first swivel connector having a central axis, first and second opposed ends, and an swivel aperture extending along the central axis of the first swivel connector, the first swivel connector being capable of relative rotational movement between its first and second ends, around the central axis of the first swivel connector, wherein the first end includes an attachment aperture extending transversely to the central axis of the first swivel connector and the second end is attached proximate to the attachment end of the first handle; and (ii) a first selectively removable fastener selectively extending through the attachment aperture and one of the member apertures to selectively adjust the length of the flexible member separating the attachment ends of the first and second handles.

2. The martial arts training device and weapon of claim 1 wherein the first attacher and the second attacher are selectively attached to the flexible member so that the length of the flexible member separating the attachment ends of the first and second handles can be selectively adjusted at each handle.

3. The martial arts training device and weapon of claim 1 wherein:

(a) the second handle includes a second passageway which extends from its attachment end into the second handle along a central axis of the second handle;

(b) the flexible member has at least three member apertures extending therethrough; and (c) the second attacher includes: (i) a second swivel connector attached at the attachment end of the second handle, the second swivel connector having a central axis, first and second opposed ends, and an swivel aperture extending along the central axis of the second swivel connector, the second swivel connector being capable of relative rotational movement between its first and second ends, around the central axis of the second swivel connector, wherein the first end includes an attachment aperture extending transversely to the central axis of the second swivel connector and the second end is attached to the attachment end of the second handle; and (ii) a second selectively removable fastener extending through the attachment aperture in the second swivel connector and one of the member apertures in the flexible member.

4. The martial arts training device and weapon of claim 3 wherein the flexible member is a chain and at least a portion of the chain extends through the swivel apertures in the swivel connectors into the first and second passageways.

5. The martial arts training device and weapon of claim 3 wherein the second end of each swivel connector is selectively removable attached to the attachment end of the respective handles.

6. The martial arts training device and weapon of claim 5 wherein the attachment end of each handle includes a handle connector and the second end of each swivel connector includes a attacher connector which connects to the respective handle connector.

7. The martial arts training device and weapon of claim 6 wherein each handle connector includes an externally threaded surface and each attacher connector includes an internally threaded surface sized to engage the externally threaded surface.

8. The martial arts training device and weapon of claim 2 wherein the flexible member is a chain.

9. The martial arts training device and weapon of claim 1 wherein the flexible member is a chain and at least a portion of the chain extends through the swivel aperture in the swivel connector into the first passageway.

10. The martial arts training device and weapon of claim 1 wherein the first attacher is selectively removable attached to the attachment end of the first handle and the second attacher is selectively removable attached to the attachment end of the second handle.

11. The martial arts training device and weapon of claim 10 wherein the attachment end of the first handle includes a first handle connector and the first attacher includes a first attacher connector which connects to the first handle connector and the attachment end of the second handle includes a second handle connector and the second attacher includes a second attacher connector which connects to the second handle connector.

12. A martial arts training device and weapon comprising:

(a) first and second handles suitable for gripping with a human hand, each handle having an attachment end, at least the first handle includes a first passageway which extends from the attachment end into the first handle along a central axis of the first handle;

(b) a flexible member comprising a chain having at least two member apertures extending therethrough;

(c) a first attacher attached proximate to the attachment end of the first handle for attaching the first handle to the flexible member; and (d) a second attacher attached proximate to the attachment end of the second handle for attaching the second handle to the flexible member;

wherein the first attacher is selectively attached to the attachment end of the first handle and the second attacher is selectively attached to the attachment end of the second handle;

wherein the attachment end of each handle includes a handle connector and first and second attachers each include an attacher connector which connects and mates with its respective handle connector;

wherein, at least the first attacher includes (i) a swivel connector attached at the attachment end of the first handle, the swivel connector having a central axis, first and second opposed ends, and a swivel aperture extending along the central axis of the swivel connector, the swivel connector being capable of relative rotational movement between its first and second ends around the central axis of the swivel connector, wherein the first end includes an attachment aperture extending transversely to the central axis of the swivel connector and the second end is attached to the attacher connector; and (ii) a first selectively removable fastener extending through the attachment aperture and one of the member apertures in the flexible member;

wherein the length of the flexible member separating the attachment ends of the first and second handles can be selectively adjusted;

wherein the first attacher is attached proximate to the attachment end of the first handle and second attacher is attached proximate to the attachment end of the second handle throughout the selective adjustment of the length of flexible member separating the attachment ends of the first and second handles;

wherein at least a portion of the chain extends through the swivel aperture in the swivel connector into the first passageway.

13. A martial arts training device and weapon comprising:

(a) first and second handles, suitable for gripping with a human hand, each handle having an attachment end, wherein (i) each handle includes a passageway which extends into the handle from the attachment end and (ii) the attachment end of each handle includes an externally threaded surface;

(b) a flexible member having a plurality of member apertures extending transversely therethrough;

(c) a first attacher for attaching the attachment end of the first handle to the flexible member and a second attacher for attaching the attachment end of the second handle to the flexible member, wherein each attacher includes:

(i) a swivel connector having a central axis, first and second opposed ends, and an swivel aperture extending along the central axis of the swivel connector, the swivel connector being capable of relative rotational movement around its central axis and between its first and second ends, wherein the first end includes an attachment aperture extending transversely to the central axis of the swivel connector; and (ii) an internally threaded surface which mates with the externally threaded surface of the handle;

(d) a pair of selectively removable fasteners, each fastener extending through the attachment aperture of one of the swivel connectors and one of the member apertures in the flexible member.

14. The martial arts training device and weapon of claim 13 wherein the flexible member is sufficiently long so that a portion of the flexible member extends through each swivel aperture into each passageway.

15. The martial arts training device and weapon of claim 13 wherein the flexible member is a chain.

* * * * *